US007872580B2

(12) United States Patent
Dorfner et al.

(10) Patent No.: US 7,872,580 B2
(45) Date of Patent: Jan. 18, 2011

(54) SYNTHETIC GEOMATERIALS WITH TRANSPONDER TECHNOLOGY

(75) Inventors: Konrad Hubert Dorfner, Wilhering (AT); Rainer Günter Lugmayr, Asten (AT)

(73) Assignees: Tencate Geosynthetics Austria Gesellschaft m.b.H., Linz (AT); Schreiner GmbH & Co. KG, Oberschleissheim (DE)

( * ) Notice: Subject to any disclaimer, the term of this patent is extended or adjusted under 35 U.S.C. 154(b) by 730 days.

(21) Appl. No.: 11/640,908

(22) Filed: Dec. 19, 2006

(65) Prior Publication Data

US 2007/0138304 A1 Jun. 21, 2007

(30) Foreign Application Priority Data

Dec. 19, 2005 (EP) ..... 05027723

(51) Int. Cl.
*G08B 13/14* (2006.01)
*G06K 19/06* (2006.01)

(52) U.S. Cl. ..... 340/572.1; 340/572.8; 235/492

(58) Field of Classification Search ..... 340/572.1, 340/572.8, 870.07, 870.16; 235/492, 376, 235/375; 73/768, 775, 779, 784
See application file for complete search history.

(56) References Cited

U.S. PATENT DOCUMENTS 5,792,337 A * 8/1998 Padovani et al. ..... 205/775.5
5,996,413 A * 12/1999 Iyer et al. ..... 73/592
7,034,660 B2 * 4/2006 Watters et al. ..... 340/10.41

* cited by examiner

*Primary Examiner*—Toan N Pham
(74) *Attorney, Agent, or Firm*—Wenderoth, Lind & Ponack, L.L.P.

(57) ABSTRACT

Synthetic geomaterials, such as geotextiles, geocomposites or geogrids (woven, knitted or of monolithic strips), characterized in that the synthetic geomaterial comprises at least one transponder applied thereon for storing and for calling up data related to product and/or state and condition and/or project.

20 Claims, No Drawings

SYNTHETIC GEOMATERIALS WITH TRANSPONDER TECHNOLOGY

The invention relates to synthetic geomaterials, such as geotextiles, geocomposites, geogrids (woven, knitted or of monolithic strips) and the like, which are utilized during rehabilitation or in the production of asphalt and concrete surfaces or in the production of earth fortifications and which include a storage function for calling-up, identifying and tracking and tracing data related to product, state or condition and project.

Synthetic geomaterials utilized for the rehabilitation and production of asphalt or concrete surfaces, such as road constructions, airport runways and the like, are known.

Such synthetic geomaterials are primarily comprised of polyolefins, for example polypropylene, polyethylene, their copolymers or PVA mixtures, as well as polyesters and glass. They are utilized in the form of geotextiles, geocomposites, geogrids and the like.

The synthetic geomaterial is utilized in the roadbed in the construction of asphalt or concrete travel surfaces, in particular for the fortification of the subgrade and for drainage.

By using synthetic geomaterial in the asphalt or concrete surface the penetration of precipitation water is prevented and the bending tensile stress between surface and subgrade is reduced. Reflection cracking, as well as crack propagation in the asphalt or concrete surface is reduced. Utilization of the synthetic geomaterial effects the fortification of the entire construction.

However, until now checking and verifying the state and condition of the road or the state of the road bed in the rehabilitation or production of asphalt or concrete surfaces can currently only take place by visual inspection or removal of samples.

The aim of the invention is providing synthetic geomaterials for utilization in the rehabilitation or production of asphalt or concrete surfaces, which additionally offer the capability of storing data related to product or state and condition. It should also be possible to call up such data.

Subject matter of the invention are therefore synthetic geomaterials, such as geotextiles, geocomposites or geogrids, characterized in that the synthetic geomaterial includes a transponder applied thereon for storing and for calling up data related to product and/or state.

The synthetic geomaterial is preferably comprised of thermoplastics, in particular polyolefins, such as polypropylene, polyethylene, their copolymers or mixtures or blends or PVA, of polyesters and glass and their mixtures.

Fibrous web materials of endless thermoplastic filaments are preferably employed. The thermoplastic filaments are for example fibers of polypropylene, polyamides or polyester. The fibrous web materials may be mechanically stretched and/or needled or thermally strengthened.

Especially suitable are for example commercially available products, such as products from the Polyfelt® PGM group, Polyfelt TS, Polyfelt Rock PEC, Polyfelt Rock G and the like.

Onto this synthetic geomaterial, preferably onto the fibrous web material, are now applied transponders at defined distances.

The transponders are self-adhesive and at least two transponders per roll are applied.

As transponders can be introduced any desired data stores, which can be read out wirelessly, i.e. via an air interface. Passive transponders are preferably utilized, which comprise as electronic components an antenna, optionally with tuning elements, and compact electronic circuitry, for example in the form of a chip. The electronic circuitry comprises an analog receiving and transmitting circuit with succeeding digitizer and data processing unit. The latter accesses a store, which may contain variable as well as nonvariable data.

Herein, for example, a nonvariable, unique numbering of the transponder, as well as information about the road state, optionally to be updated, are deposited.

The electronic circuitry is supplied from the communication field with energy which is also received via the antenna and therewith a separate battery supply becomes superfluous in the passive transponder. This has in particular the advantage that the transponder is comprised of a minimal number of structural parts, thus is cost-effective in production, can be implemented such that it is robust for the application described here, and, finally, is available in large number for the application described here.

As the communication fields can be considered all physically feasible fields; these are electrical or magnetic AC fields or also electromagnetic waves. Due to the simple structural form, transponders with operating frequencies in the High-Frequency range ("HF", for example 13.56 MHZ) or in the Ultra High-Frequency range (UHF, for example around 866 MHZ in Europe or around 916 MHZ in the USA) lend themselves for use.

While HF transponders operate today with magnetic AC fields, UHF transponders interact with electromagnetic waves.

Both types of transponders can be employed for the application described here.

However, preferred are HF transponders. It is found that these are considerably less sensitive to external environmental effects and are also still readily readable and writable in lower asphalt and concrete surfaces and in particular in the presence of water.

The transponder preferably employed therefore comprises a base layer of preferably (but not necessarily) polyester sheeting with thicknesses typically about 50 μm.

Thereon a structured metal coating is applied which functions as an antenna. Onto the ends of the antenna is bonded the electronic circuit, in this case a silicon RFID chip. This bonding can be implemented in various ways.

Preferred is the use of the "flip chip" technique. Herein the chip is mechanically adhered through a liquid or paste-like adhesive agent, also referred to as "underfiller", onto the antenna structure/base material, whereby, after the curing, the mechanical load bearing capacity is also considerably increased.

The transponder structure for the application described here comprises an adhesive agent beneath the base material and a mechanical protection above the antenna/chip structure. When applying the synthetic geomaterials, as well as also during the subsequent continued disposition in the rock, the mechanical loading of the transponder is high for the transponder chip. Selective punctiform pressures in places can lead to the debonding of the chip from the antenna or to the cracking of the chip. The task of the mechanical protection therefore is to divert the loading over large areas away from the chip. Generally conceivable are rigid housings. However, the arguments against them are the expensive production and the great increase in bulk of such transponders. Better suited are flat transponder tags, since they are especially conceptualized for the application described here.

As the adhesive agent can be employed any type which firmly connects the polyester sheeting with the synthetic geomaterial and which fulfils the mechanical and thermal requirements during the handling of the synthetic geomaterial. Advantageous have been found to be special adhesive agents, which, upon the contact of the transponder with the synthetic geomaterial, form immediately a secure and permanent adhesive connection without further curing. To be considered here are in particular acrylate adhesives. A special resin modification permits the adhering onto the above cited low-energy surfaces of the synthetic geomaterial. A greater thickness of, for example, 200 μm equalizes the textile surface roughness and ensures the adhering over the entire area. Suitability over a wide temperature range (for example from -40° C. to 120° C., briefly to 160° C.) also ensures the adhering under all climatic conditions and during the handling of the synthetic geomaterial in the field of asphalting.

For the purpose of mechanical protection thicker sheeting layers may also be considered. Moreover, a synthetic poured overcasting has unexpectedly yielded the best results. Castings having a mean hardness have shown the most secure coverage. The overcasting, for example of polyurethane, equalizes the punctiform unevennesses of the loading rock layers. Forces emanating from individual rock tips and edges and which, due to the punctiform effect, may exert a very high pressure onto the chip and may destroy it, are absorbed over a large area through the wetting with the casting layer and are distributed areally uniformly over the transponder.

A force acting thus all-around onto the chip does not destroy it even upon the compaction of the asphalt surface. Especially suitable have been found to be casting thickness of 1-3 mm, which subsequently determine substantially the total thickness of the transponder.

A further enhancement of the protection of the electronic circuitry can be attained from combinations of this casting protective layer with subjacent cover sheetings. It has been found that a PET sheeting of 50 μm thickness represents already a good barrier for rock tips and edges penetrating deeply into the casting compound.

A significant variable for the reading range is the antenna area of an HF transponder. It determines the sensitivity and therewith also the possible reading distances. In addition, it is necessary to differentiate between rather short-range transponder chips for money/cash cards or security applications and long-range transponder chips for logistics applications. The latter together with larger transponder antennas are advantageously employed in the present application With bank card-sized transponder antennas and mid-range reading devices distances of up to 0.5 m and with long-range reading devices distances of up to 0.8 m are bridged. With transponders of twice the bank card format reading distances of 1 m can also be secured. For the storage slightly higher energy is required in the transponder. For that reason the ranges for storages may decrease approximately 10 to 20% with respect to the preceding values. However, the stated distances in that case are still sufficient to detect transponders within asphalt or concrete surfaces.

HF transponders have different storage capacities. Common to all is a unique identification number, most often 8-bytes long, which is invariable and programmed into the chip by the producer. Furthermore, depending on the type of chip, the user has available an additional 32 to 1024 bytes or more of user storage.

On a transponder subsequently product data and state data are stored. For example, data about the type and quantity of synthetic geomaterials and construction materials, layer thicknesses, traffic loading, road state and condition, climatic conditions, quality identification numbers and characteristics and the like can be stored.

The synthetic geomaterial is subsequently installed for the production [sic: of new surfaces] and/or the rehabilitation of damages, such as cracks and the like, into already existing asphalt and concrete surfaces.

The synthetic geomaterial is, additionally, also utilized in new constructions.

For example in the production of new asphalt or concrete surfaces (new constructions) a bearing layer, most often a concrete-stabilized gravel sand bearing layer is established. The synthetic geomaterial is subsequently laid and a binder is optionally applied, or the synthetic geomaterial is laid directly into the binder. The application of the new asphalt or concrete surface can subsequently take place. The synthetic geomaterial is laid such that between the webs of the synthetic geomaterial an overlap is generated or no overlapping occurs.

In the rehabilitation of existing asphalt or concrete surfaces the synthetic geomaterial is applied analogously onto the old covering, which optionally can be partially removed, and subsequently the application of the new covering takes place utilizing the synthetic geomaterial as described above.

If necessary, before the application of the synthetic geomaterial it may be required to fill in possible potholes or deeper running cracks and the like with a jointing filler or, in the event of a severely destroyed roadway surface, to apply a profile equalization, for example to apply cold or hot coated materials.

After the installation of the synthetic geomaterial in the asphalt layer, in the course of test drives or checks the data stored on the transponder can be queried, compared with the data determined during these drives and the newly determined data can be stored again on the transponder.

For example, the abrasion or the wear of an asphalt or concrete surface can thus be determined as a function of the loading and the time period of the loading.

These data and their changes can subsequently be utilized as an aid in making a decision regarding the rehabilitation or renewed rehabilitation of the road.

The invention claimed is:

1. A synthetic geomaterial comprising (1) at least one transponder for storing and for calling up data related to a product, a state, a condition, and/or a project; and (2) a web or grid of synthetic fibers selected from the group consisting of polypropylene, polyamide, polyvinyl alcohol and aramid, wherein the transponder is applied to a surface of the web or grid of synthetic fibers.

2. The synthetic geomaterial as claimed in claim 1, wherein several transponders at defined spacings from one another are applied to the surface of the web or grid of synthetic fibers.

3. The synthetic geomaterial as claimed in claim 1, wherein the transponder is applied to the surface of the web or grid of synthetic fibers by adhesion.

4. The synthetic geomaterial as claimed in claim 1, wherein the transponder is stored with data related to traffic loading, the state or the condition of a road, construction materials or layer thickness.

5. The synthetic geomaterial as claimed in claim 1, wherein the web or grid of synthetic fibers is a mechanically strengthened geotextile of endless fibers of polypropylene.

6. The synthetic geomaterial as claimed in claim 1, wherein the transponder is a passive transponder.

7. The synthetic geomaterial as claimed in claim 6, wherein the transponder comprises a thick adhesive agent for application to the web or grid of synthetic fibers.

8. The synthetic geomaterial as claimed in claim 7, wherein the adhesive agent is an acrylate adhesive agent.

9. The synthetic geomaterial as claimed in claim 8, wherein the adhesive agent is capable of being employed in a temperature range from -40° C. to 160° C.

10. The synthetic geomaterial as claimed in claim 9, wherein the transponder comprises a protective layer.

11. The synthetic geomaterial as claimed in claim 10, wherein the protective layer comprises a casting compound.

12. The synthetic geomaterial as claimed in claim 11, wherein the casting compound cures to form a compound of medium hardness.

13. The synthetic geomaterial as claimed in claim 12, wherein the casting compound is reinforced by a subjacent sheeting layer of 50 μm thickness.

14. The synthetic geomaterial as claimed in claim 13, wherein the transponder comprises an antenna area suitable for reading ranges up to 1 m.

15. The synthetic geomaterial as claimed in claim 14, wherein the transponder comprises an antenna area suitable for reading ranges from 0.5 to 0.8 m.

16. The synthetic geomaterial as claimed in claim 1, wherein the transponder stores variable and invariable data.

17. The synthetic geomaterial as claimed in claim 1, wherein the web or grid of synthetic fibers is a geotextile, a geocomposite or a geogrid.

18. The synthetic geomaterial as claimed in claim 1, wherein the web or grid of synthetic fibers is woven, knitted, or in the form of monolithic strips.

19. The synthetic geomaterial as claimed in claim 1, wherein the synthetic geomaterial is laid over a bearing layer, and a binder is optionally applied to the synthetic geomaterial.

20. The synthetic geomaterial as claimed in claim 19, wherein the bearing layer is asphalt or concrete.

* * * * *